US008025459B2

(12) United States Patent
Buschmann et al.

(10) Patent No.: US 8,025,459 B2
(45) Date of Patent: Sep. 27, 2011

(54) ROAD FINISHER

(75) Inventors: Martin Buschmann, Neustadt (DE); Arthur Braun, Deidesheim (DE)

(73) Assignee: Joseph Voegele AG, Mannheim (DE)

( * ) Notice: Subject to any disclaimer, the term of this patent is extended or adjusted under 35 U.S.C. 154(b) by 0 days.

(21) Appl. No.: 12/165,949

(22) Filed: Jul. 1, 2008

(65) Prior Publication Data

US 2009/0285631 A1 Nov. 19, 2009

(30) Foreign Application Priority Data

May 14, 2008 (EP) ..... 08008917

(51) Int. Cl.
*E01C 19/18* (2006.01)

(52) U.S. Cl. ..... 404/111; 404/108

(58) Field of Classification Search ..... 404/111, 404/101, 108, 110
See application file for complete search history.

(56) References Cited

U.S. PATENT DOCUMENTS

| | | | | |
|---|---|---|---|---|
| 4,072,435 | A * | 2/1978 | Coho et al. | 404/110 |
| 4,196,827 | A * | 4/1980 | Leafdale | 222/146.2 |
| 4,695,186 | A * | 9/1987 | King | 404/111 |
| 4,944,631 | A * | 7/1990 | Egli | 404/91 |
| 4,971,476 | A | 11/1990 | Guillon et al. | |
| 5,000,615 | A | 3/1991 | Murray | |
| 5,026,206 | A | 6/1991 | O'Connor | |
| 5,178,486 | A | 1/1993 | Perrin et al. | |
| 5,279,500 | A | 1/1994 | Perrin et al. | |
| 5,324,136 | A | 6/1994 | Reymonet et al. | |
| 5,417,338 | A * | 5/1995 | Roy et al. | 220/23.86 |
| 5,590,976 | A * | 1/1997 | Kilheffer et al. | 404/72 |
| 5,735,634 | A | 4/1998 | Ulrich et al. | |
| 5,851,085 | A * | 12/1998 | Campbell | 404/75 |
| 5,904,296 | A | 5/1999 | Doherty et al. | |
| 6,071,040 | A * | 6/2000 | Macku et al. | 404/108 |
| 6,776,557 | B2 | 8/2004 | Barnat et al. | |
| 6,802,464 | B2 | 10/2004 | Marconnet et al. | |
| 6,805,516 | B2 | 10/2004 | Barnat et al. | |
| 7,004,675 | B2 | 2/2006 | Wayne | |
| 7,033,106 | B2 * | 4/2006 | Harvey | 404/107 |
| 7,077,601 | B2 * | 7/2006 | Lloyd | 404/85 |
| 7,104,724 | B2 | 9/2006 | Terry | |
| 7,134,806 | B2 * | 11/2006 | Lazic | 404/111 |
| 2003/0116644 | A1 | 6/2003 | Thompson et al. | |
| 2003/0173361 | A1 * | 9/2003 | Lee | 220/23.88 |
| 2003/0197364 | A1 * | 10/2003 | Winter | 280/838 |
| 2007/0231069 | A1 | 10/2007 | Buschmann | |
| 2007/0243017 | A1 | 10/2007 | Buschmann | |

FOREIGN PATENT DOCUMENTS

| | | |
|---|---|---|
| DE | 1594753 | 2/1971 |
| DE | 4101417 U | 10/1991 |
| DE | 9211950 | 1/1993 |
| DE | 29911151 | 9/1999 |
| DE | 9317124 | 4/2005 |
| EP | 0409700 | 1/1991 |
| EP | 467255 | 1/1992 |
| EP | 0517579 | 12/1992 |

(Continued)

*Primary Examiner* — Thomas Will
*Assistant Examiner* — Abigail A Risic
(74) *Attorney, Agent, or Firm* — Fish & Richardson P.C.

(57) ABSTRACT

The present invention describes a road finisher for laying a paving material, comprising a material bunker for paving material and a spray jet module. In order to increase the spray carrying capacity in a structurally simple manner, it is suggested that a reservoir unit comprising a spray reservoir and a paving material reservoir should be arranged in the material bunker.

11 Claims, 3 Drawing Sheets

FOREIGN PATENT DOCUMENTS

Figure 1:
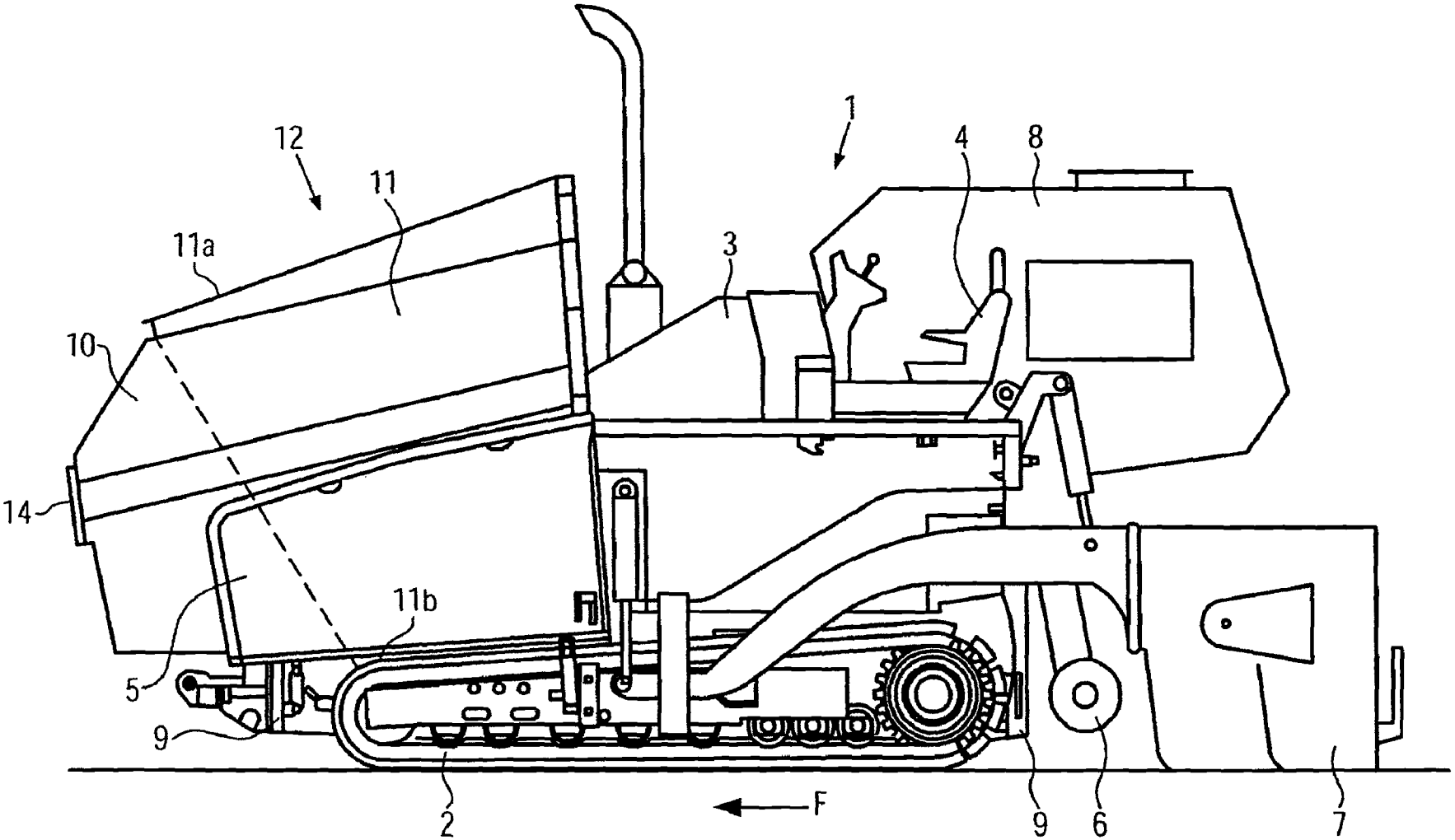

| | | |
|---|---|---|
| EP | 517579 | 12/1992 |
| EP | 691433 | 1/1996 |
| EP | 750070 | 12/1996 |
| EP | 1845197 | 10/2007 |
| FR | 2866907 | 9/2005 |
| JP | 2004018052 | 1/2004 |

* cited by examiner

ROAD FINISHER

The present invention relates to a road finisher for laying a paving material of the type explained in the preamble of claim 1.

Such a road finisher is known e.g. from DE-9317124 U. The known road finisher is provided with a material bunker for the customary paving material in the form of an asphalt mixture and, in addition, with a sprayer by means of which a spray, e.g. in the form of a binder or an adhesion promoter, can be applied to the ground and/or to intermediate layers so as to improve the connection between the layers. One problem arising in connection with the construction of road finishers which are equipped with such sprayers is that a sufficiently large amount of spray has to be accommodated on the road finisher. In the case of the known road finisher, a comparatively large spray tank is installed behind a prime mover (engine) of the road finisher when seen in the direction of travel, the prime mover being provided directly behind the material bunker. This, however, is a location where only a limited amount of space is available so that the holding capacity of the spray tank is limited as well.

DE 91 16 781 U discloses another road finisher in the case of which a spray tank is arranged directly behind the material bunker, when seen in the direction of travel. This, however, is a location where said spray tank reduces the length of the material bunker in the direction of travel and this may lead to charging problems. It follows that also this location can only be used for accommodating a spray tank having a limited holding capacity.

In addition, U.S. Pat. No. 5,178,486 discloses a road finisher provided with a spray tank that is accommodated on the roof of the road finisher. A spray tank provided at this location will, however, displace the centre of gravity of the road finisher to the top, and this may prove to be disadvantageous for the operating characteristics of the road finisher, in particular in steeply sloping terrain.

Furthermore, EP 517579 discloses a road finisher in which spray containers are installed in the pivoting gates of the material bunker. This, however, is a location where only a very limited amount of space is available so that the amount of spray that can be carried along is only very small. Moreover, for compensating the heavier weight, it is here necessary to provide a stronger drive unit for moving the pivoting gates or doors of the bunker.

It is the object of the present invention to provide a road finisher which is able to carry along a sufficiently large amount of spray in a structurally simple manner.

This object is achieved by the features specified in claim 1.

When a reservoir unit comprising a spray reservoir and a paving material reservoir is arranged in the material bunker of the road finisher in the manner described in the present invention, the operating characteristics of the road finisher will not be influenced negatively. The reservoir unit can be designed for optimum holding capacity in a structurally simple manner and under utilization of all the space that is available on the road finisher. The reservoir unit can also be implemented such that no or only little loading space for the paving material will get lost.

According to a preferred embodiment, the reservoir unit is releasably secured in position in the material bunker existing on the road finisher so that, if the work to be done can be accomplished without using any spray or without using additional spray, the road finisher can travel with the conventional material bunker after the removal of the reservoir unit.

In order to make the charging of the first reservoir with paving material as simple as possible, the second reservoir used for accommodating the spray is preferably arranged on both sides of the first reservoir, when seen transversely to the direction of travel.

For increasing the holding capacity of the second reservoir still further, said second reservoir can encompass the first reservoir in a U-shape, i.e. it can extend along the sides parallel to the direction of travel and along one of the sides transversely to the direction of travel.

The second reservoir is preferably implemented as an auxiliary tank to an existing main spray reservoir.

According to a preferred embodiment, the second reservoir is provided with operating means which are necessary for operating the same, the operating means used being preferably a pump unit and a burner heating unit. Alternatively, any other kind of heating can be used as well.

Figure 2:
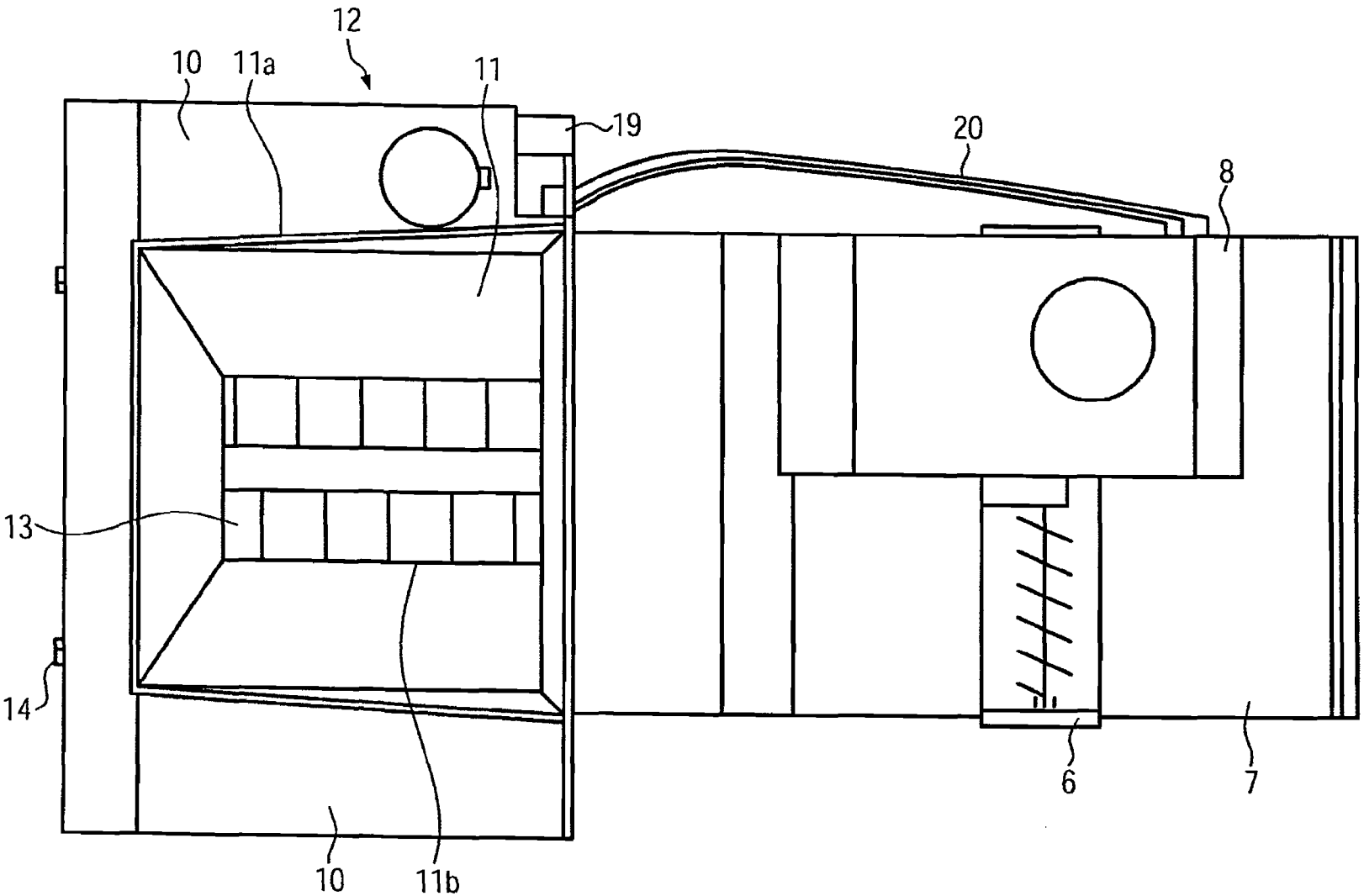
Figure 3:
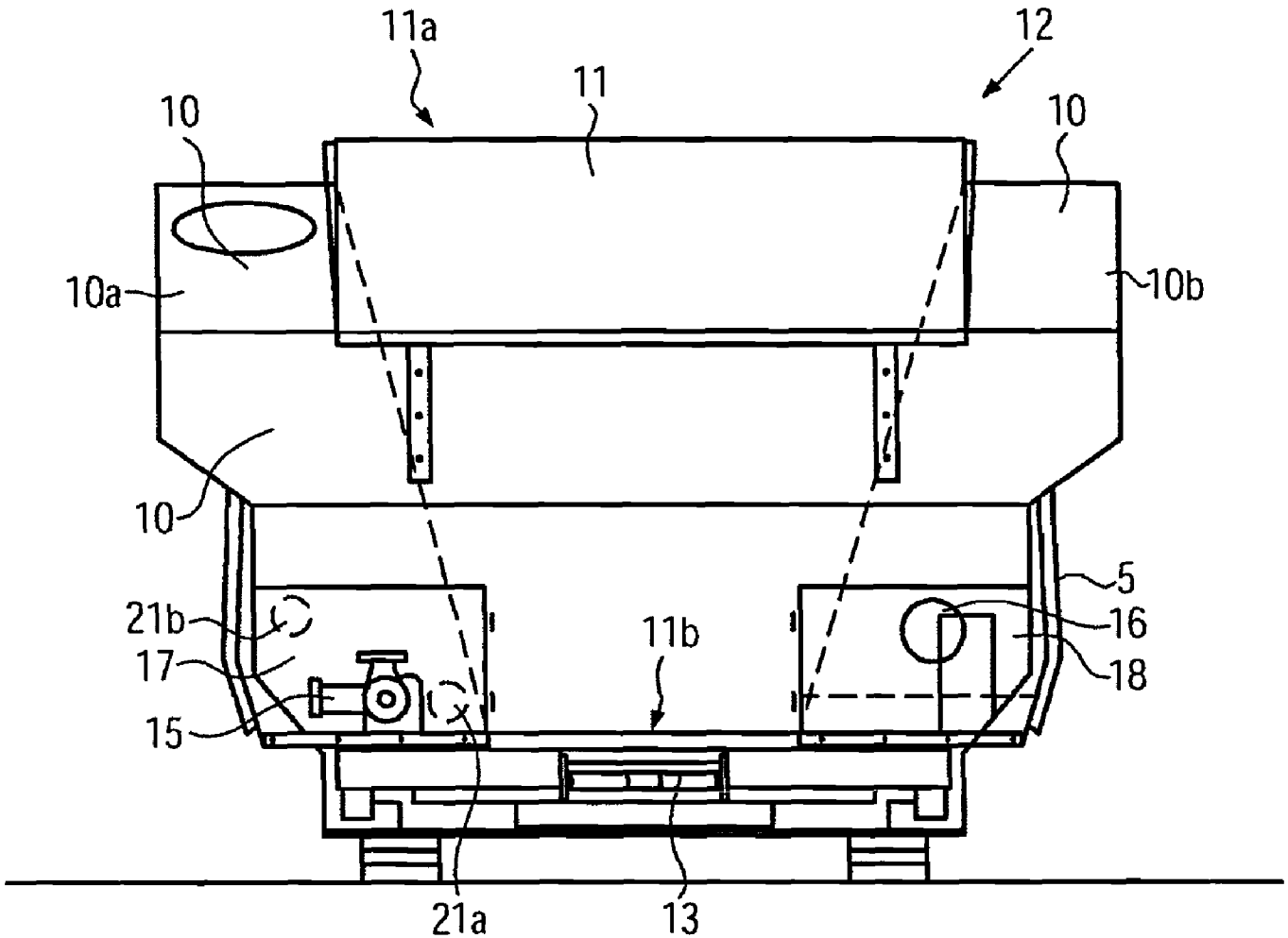

One embodiment of the present invention will be explained in detail hereinbelow making reference to the drawings, in which:

FIG. 1 shows a side view of a road finisher implemented according to the present invention, FIG. 2 shows a top view of the front part of a road finisher according to the present invention, and FIG. 3 shows a view of a road finisher according to the present invention, seen from the front.

FIG. 1 shows an embodiment of a road finisher 1 which, with the exception of the details according to the present invention, may have any conventional structural design. The road finisher 1 shown comprises an undercarriage 2 provided with crawlers and used for moving the road finisher 1, driven by a motor drive which is not shown, in the direction of travel F; the road finisher 1 may, however, also have a wheeled undercarriage. The road finisher 1 comprises a chassis 3 with a driver's cab 4, and it is provided with a conventional material bunker 5 which is arranged on the road finisher front, when seen in the direction of travel F, and which is open at the top or can be opened at the top for charging.

The road finisher 1 additionally comprises the usual conveyor means (conveyor belt or scraper belt 13, cf. FIGS. 2 and 3) which convey, in a direction opposite to the direction of travel F, the paving material from the material bunker 5 to the rear where it is fed to a transverse distributor 6, which is implemented e.g. as a screw and which distributes the paving material over the whole laying width in a direction transversely to the direction of travel F. The means dragged by the road finisher 1 are the conventional means 7, such as a screed, used for smoothing and compacting the paving material fed by the transverse distributor 6.

The road finisher 1 according to the present invention can be configured for laying bituminous material, but it may also be configured for making concrete pavements.

The road finisher 1 additionally comprises a spray jet module 8 arranged on the chassis 3 next to the driver's cab 4. The spray jet module 8 comprises the usual spray reservoir, which is here implemented as a main reservoir and which can have the usual holding capacity in the range of approx. 1,000 l; depending on the respective structural design, it may, however, also be larger or smaller. In addition to the main spray reservoir, further operating means which are required for operating the spray jet module 8 are provided, such as a heating with associated insulation, pumps, control means or the like. The spray jet module is adapted to accommodate therein any kind of sprayable materials, in particular liquids, which are necessary for executing the work to be done by the road finisher 1, e.g. bitumen emulsion, binder, adhesion promoter or the like.

The spray jet module 8 communicates with spray jets 9 in the usual way, said spray jets 9 being arranged such that they adequately distribute the spray on the surface to be sprayed. The spray jet module 8 and the spray jets 9 have a conventional structural design of the type described e.g. in EP A-1845197, which is herewith referred to.

The road finisher 1 according to the present invention comprises a further spray reservoir 10; in the embodiment shown, this spray reservoir 10 is implemented as an auxiliary tank for the spray jet module 8, but it may also be the only spray reservoir. As can especially be seen in FIG. 3, the spray reservoir 10 is accommodated in the material bunker 5 in such a way that it will not impede the paving material charging process. In particular, the spray reservoir 10 is combined with a paving material reservoir 11 so as to form a reservoir unit 12. The paving material reservoir 11 is implemented as a hopper with a feed opening 11*a* and terminates in a discharge opening 11*b* that conducts the material to conveyor belts 13 (scraper belts) which then feed said material to a transverse distributor 6.

The reservoir unit 12 thus comprises the paving material reservoir 11 as a first reservoir as well as a spray reservoir 10 which is arranged on the paving material reservoir 11 and which is implemented as a second reservoir. The second reservoir 10 can be bipartite, both the subreservoirs 10*a*, 10*b* having an essentially identical structural design and being fixed, in a mirror-inverted mode of arrangement, to the two sides of the first reservoir 11 oriented in the direction of travel such that they extend along said sides and parallel thereto. The spray subreservoirs 10*a*, 10*b* on both sides of the first reservoir 11 (when seen in a direction transversely to the direction of travel) are in flow communication; this flow communication can be realized by suitable pipe connections or by a U-shaped construction in front of and/or behind the reservoir 11, when seen in the direction of travel. A connection of the two subreservoirs 10*a*, 10*b* in front of the first reservoir 11, when seen in the direction of travel F, is preferred, since charging of the first reservoir 11 will not be impeded in this case. The spray reservoirs and their connections also comprise a heating unit.

As can especially be seen from FIG. 2, the reservoir unit 12 has dimensions which are broader than those of the material bunker 5 in a direction transversely to the direction of travel F and longer than those of the material bunker 5 in a direction parallel to the direction of travel F so that, in spite of the additional reservoir 10, there will be ample space for keeping paving material in the first reservoir 11. Since the reservoir unit 12 can be longer than the material bunker 5 in the in the direction of travel F, it has provided thereon the usual spacers 14 for the charging vehicle used for charging the two reservoirs 10, 11 with paving material and spray, respectively; these spacers 14 are provided on the front side of the reservoir unit 12 when seen in the direction of travel F.

The reservoir unit 12 additionally comprises operating means, such as the pump 15 shown in FIG. 3 as well as a heating unit 16 (e.g. a burner) having a separate, independent fuel tank (e.g. Diesel tank) and, if desired, a temperature control, the pump 15 being accommodated in a chamber 17 and also the heating unit 16 being accommodated in a separate chamber 18 in the reservoir unit. The chambers 17 and 18 are preferably located in a lower area of the reservoir unit 12 on both sides of the first reservoir 11 and of its discharge opening 11*b*. Filling of the reservoir 10 is accomplished by a self-sucking pump 15 via a connection 21*a* from a tank vehicle. Alternatively, the tank vehicle can fill the reservoir directly via a connection 21*b* by means of a pump of its own. The reservoir unit 12 is additionally provided with a control unit 19 (FIG. 2) for the pump and the heating unit 16, which, in the embodiment shown, is arranged on the reservoir unit side located at the rear when seen in the direction of travel. Heating is effected by an automatic, temperature-dependent activation of the heating unit (e.g. burner), the content of the reservoir 10 being circulated (in a temperature-dependent manner) through the pump 15. The heating unit 16 conducts the air heated by the burner through pipes installed in the second reservoir 10 so as to heat the spray contained therein; this is not shown.

Furthermore, the second reservoir 10 communicates via spray connection lines 20 and supply lines with the spray jet module 8 which feeds the spray heads and spray means 9, respectively. The spray jet module 8 recognizes automatically when the content of its main spray tank dropped to a minimum and sucks spray from the auxiliary tank automatically. The auxiliary tank itself is provided with a level indicator.

The reservoir unit 12 is fixed in the interior of the material bunker 5 in a simple manner and, preferably, it is releasably fixed in said material bunker 5. This allows the reservoir unit 12 to be removed, when the work to be done by the road finisher 1 does not require any spray or when the amount of spray required is so small that the main reservoir in the spray jet module 8 will suffice.

The spray carrying capacity can be increased by at least 5000 l by the embodiment according to the present invention.

The embodiment described and specified hereinbefore can also be modified such that the reservoir unit, instead of the material bunker, can be secured in position on the road finisher. In addition, it is possible to accommodate one or a plurality of spray reservoirs directly in the interior of the material bunker so that the material bunker still serves as a reservoir for the paving material. Last but not least, the present invention can be used for any type of road finishers.

The invention claimed is:

1. A road finisher for laying a paving material comprising a material bunker carried by the road finisher for paving material and a spray jet module, and a removable reservoir unit comprising a spray reservoir section and a paving material reservoir section, secured in position in the material bunker and adapted to be fixed and removable from the material bunker as a single unit, wherein the paving material reservoir section is configured as a hopper with a feed opening.

2. A road finisher according to claim 1, wherein the spray reservoir section is provided on both sides of the paving material reservoir section.

3. A road finisher according to claim 1, wherein the spray reservoir section is of a U-shape and encompasses the paving material reservoir section.

4. A road finisher according to claim 1, wherein the spray reservoir section of the reservoir unit is implemented as an auxiliary tank to an existing main spray reservoir mounted on the road finisher.

5. A road finisher according to claim 1, wherein the spray reservoir section of the reservoir unit is provided with at least one of a heating unit and a pump unit.

6. A road finisher according to claim 4, further comprising a pump unit to fill the spray reservoir section of the reservoir unit from a tank vehicle in a self-sucking operation.

7. A road finisher according to claim 1, wherein a connection is provided for filling the spray reservoir section of the reservoir unit from a tank vehicle.

8. A road finisher according to claim 5, wherein a pump unit automatically supplies spray to a main spray reservoir from the spray reservoir section of the reservoir unit via a control unit of the spray jet module.

9. A road finisher according to claim 1, wherein the spray reservoir section of the reservoir unit further comprises a pump unit and a heating unit, and wherein a control unit is provided for controlling the pump unit and the heating unit.

10. A road finisher according to claim 9, wherein the control unit circulates the spray in the spray reservoir section of the reservoir unit via the pump unit in a temperature-dependent manner.

11. A road finisher according to claim 1, wherein the spray reservoir section of the reservoir unit is provided with a heating unit including temperature control means.

* * * * *